US008769915B2

(12) United States Patent
Kobayashi et al.

(10) Patent No.: US 8,769,915 B2
(45) Date of Patent: Jul. 8, 2014

(54) TABLET SUPPLY APPARATUS

(75) Inventors: Koichi Kobayashi, Ashikaga (JP); Takashi Mori, Ota (JP)

(73) Assignee: Panasonic Healthcare Co., Ltd., Toon-shi (JP)

( * ) Notice: Subject to any disclaimer, the term of this patent is extended or adjusted under 35 U.S.C. 154(b) by 390 days.

(21) Appl. No.: 12/568,994

(22) Filed: Sep. 29, 2009

(65) Prior Publication Data

US 2010/0077708 A1 Apr. 1, 2010

(30) Foreign Application Priority Data

Sep. 30, 2008 (JP) ..... 2008-252492
Sep. 30, 2008 (JP) ..... 2008-252493

(51) Int. Cl.
*B65B 57/20* (2006.01)
*B65B 57/00* (2006.01)

(52) U.S. Cl.
USPC ..... 53/498; 53/493; 53/244

(58) Field of Classification Search
CPC ..... B65B 1/06; B65B 1/40; B65B 5/103; B65B 57/20
USPC ..... 53/493, 500, 539, 244
See application file for complete search history.

(56) References Cited

U.S. PATENT DOCUMENTS 3,774,368 A * 11/1973 Paprzycki et al. ..... 53/167
4,415,098 A * 11/1983 Haas ..... 221/202
5,348,061 A * 9/1994 Riley et al. ..... 141/104
5,481,855 A 1/1996 Yuyama
5,720,154 A 2/1998 Lasher et al.
5,737,902 A * 4/1998 Aylward ..... 53/475
5,765,606 A * 6/1998 Takemasa et al. ..... 141/104
6,216,418 B1 4/2001 Kim
6,345,487 B1 * 2/2002 Luciano et al. ..... 53/54

(Continued)

FOREIGN PATENT DOCUMENTS

DE 3440010 A1 5/1986
EP 0282785 A1 9/1988

(Continued)

OTHER PUBLICATIONS

European Search Report dated Feb. 1, 2010, issued in corresponding European Patent Application No. 09012343.1.

(Continued)

*Primary Examiner* — Hemant M Desai
*Assistant Examiner* — Gloria R Weeks
(74) *Attorney, Agent, or Firm* — Westerman, Hattori, Daniels & Adrian, LLP

(57) ABSTRACT

A tablet supply apparatus including a main body having a case accommodating unit at the upper portion thereof, plural tablet cases provided in the case accommodating unit, each of the tablet cases having tablets accommodated therein, a hopper provided at the lower side of the tablet case in the main body, a nozzle for filling tablets received by the hopper into a container, the nozzle comprising a passage through which tables drop, a shutter which is freely opened and closed so as to allow or prohibit passage of dropping tablets through the nozzle, and a sensor for detecting passage of the tablets dropping through the passage at an upper side of the shutter. Furthermore, a tablet feeder for adding deficient tablets to the hopper comprises plural cells for accommodating tablets and an endless belt on which the cells are arranged on a line side by side.

3 Claims, 10 Drawing Sheets

(56) References Cited

U.S. PATENT DOCUMENTS

| | | | | |
|---|---|---|---|---|
| 6,349,999 | B1 * | 2/2002 | Takahashi et al. | 312/209 |
| 6,449,921 | B1 * | 9/2002 | Kim | 53/154 |
| 6,457,611 | B1 * | 10/2002 | Koehler | 222/462 |
| 6,494,022 | B1 * | 12/2002 | Aylward | 53/473 |
| 6,581,355 | B1 * | 6/2003 | Yuyama et al. | 53/135.1 |
| 6,761,010 | B1 * | 7/2004 | Gibson | 53/390 |
| 6,779,663 | B1 * | 8/2004 | Pocsi | 206/534 |
| 7,334,699 | B2 * | 2/2008 | Keffeler et al. | 221/93 |
| RE40,453 | E * | 8/2008 | Lasher et al. | 53/411 |
| 7,472,526 | B2 * | 1/2009 | Pearson | 53/473 |
| 7,587,878 | B2 * | 9/2009 | Kim | 53/246 |
| 7,641,073 | B2 * | 1/2010 | Kim | 221/171 |
| 7,856,794 | B2 * | 12/2010 | Zieher | 53/246 |
| 7,878,366 | B2 * | 2/2011 | Cicognani | 221/7 |
| 8,020,356 | B2 * | 9/2011 | Yuyama et al. | 53/52 |
| 8,579,153 | B2 * | 11/2013 | Yuyama et al. | 221/130 |
| 2003/0057231 | A1 * | 3/2003 | Kim | 221/263 |
| 2004/0074916 | A1 * | 4/2004 | Priebe et al. | 221/289 |
| 2005/0217208 | A1 * | 10/2005 | Cicognani | 53/54 |
| 2008/0072534 | A1 | 3/2008 | Kim | |
| 2008/0314002 | A1 * | 12/2008 | Yuyama et al. | 53/531 |
| 2010/0018986 | A1 * | 1/2010 | Kodama et al. | 221/8 |
| 2010/0043349 | A1 * | 2/2010 | Yuyama et al. | 53/52 |
| 2010/0077708 | A1 * | 4/2010 | Kobayashi et al. | 53/501 |
| 2010/0107555 | A1 * | 5/2010 | Yuyama et al. | 53/131.2 |
| 2011/0239587 | A1 * | 10/2011 | Yuyama et al. | 53/131.4 |
| 2011/0265425 | A1 * | 11/2011 | Yuyama et al. | 53/52 |

FOREIGN PATENT DOCUMENTS

| | | | | |
|---|---|---|---|---|
| EP | 0412806 | A1 | 2/1991 | |
| EP | 1728718 | A1 | 12/2006 | |
| EP | 1941858 | A1 | 7/2008 | |
| GB | 2277391 | A | 10/1994 | |
| JP | 55-074610 | U | 11/1953 | |
| JP | 58-005979 | U | 3/1957 | |
| JP | 59-106803 | U | 7/1984 | |
| JP | 63-294307 | A | 12/1988 | |
| JP | 04-087908 | A | 3/1992 | |
| JP | 2004-203433 | A | 7/2004 | |
| JP | W0 2008 029606 | * | 3/2008 | B65B 1/40 |

OTHER PUBLICATIONS

European Search Report dated Feb. 3, 2011, issued in corresponding European Patent Application No. 10013867.6.

Japanese Office Action dated Jan. 29, 2013, issued in corresponding Japanese Patent Application No. 2008-252492, with English translation (7 pages).

Japanese Office Action dated Mar. 5, 2013, issued in corresponding Japanese Patent Application No. 2008-252493, with English translation (4 pages).

European Office Action dated Jul. 18, 2012, issued in corresponding European patent application No. 09012343.1.

* cited by examiner

TABLET SUPPLY APPARATUS

INCORPORATION BY REFERENCE

The present application claims priority under 35 U.S.C. §119 to Japanese Patent Application No. 2008-252492 filed on Sep. 30, 2008 and Japanese Patent Application No. 2008-252493 filed on Sep. 30, 2008. The content of the applications is incorporated herein by reference in its entirety.

BACKGROUND OF THE INVENTION

1. Field of the Invention

The present invention relates to a tablet supply apparatus having a function of filling tablets into a container such as a bag, a bin or the like.

2. Description of Related Art

There has been hitherto known a tablet supply apparatus in that a plurality of tablet cases accommodated according to category (kind) are provided, predetermined kinds of tablets are taken out from tablet cases on the basis of input prescription data into a hopper, the collected tablets are filled from the hopper into a container such as a bag, a bin or the like and a container in which desired kinds of tablets are filled is automatically prepared. As one of the above type tablet supply apparatuses has been proposed a tablet supply apparatus having a tablet feeder for adding the tablet supply apparatus with a tablet which has not yet been set in any table case when it is required to fill a container with the tablet concerned (for example, see JP-A-2004-203433). According to these tablet supply apparatuses, tablets can be automatically continuously filled in several tens containers. Furthermore, when tablets are added to the tablet supply apparatus through the tablet feeder, an operator draws out the tablet feeder from the main body of the tablet feeder and then to the front side of the main body of the tablet supply apparatus, the tablets to be added are put into a predetermined plate of the tablet feeder, and the tablet feeder is accommodated into the tablet supply apparatus again, whereby new tablets are added.

When many tablets are continuously filled in containers by using the tablet supply apparatus described above, it takes a long time to fill the tablets in some cases, and thus it has been required to shorten the filling time of tablets. Furthermore, it is necessary to drawn out the tablet feeder to the front side of the main body when tablets are put into the tablet feeder. Therefore, when a tablet supply apparatus is installed, it is required to prepare for an installation place in which a location space for the tablet feeder drawn out to the front side of the tablet supply apparatus is surely ensured on the assumption that the tablet feed is drawn out to the front side of the tablet supply apparatus, and thus it has been difficult to install a tablet supply apparatus.

SUMMARY OF THE INVENTION

The present invention has been implemented in view of the foregoing situation, and has an object to provide a tablet supply apparatus that can shorten a time required to fill tablets.

Furthermore, the present invention has another object to provide a tablet supply apparatus that can facilitate a work of installing the tablet supply apparatus itself.

In order to attain the above object, according to a first aspect of the present invention, there is provided a tablet supply apparatus comprising: a main body having a case accommodating unit at the upper portion thereof; plural tablet cases provided in the case accommodating unit, each of the tablet cases having tablets accommodated therein; a hopper provided at the lower side of the tablet case in the main body; a nozzle for filling tablets received by the hopper into a container, the nozzle comprising a passage through which tables drop, a shutter that is disposed at some midpoint of the passage and freely opened and closed so that the passage is opened and closed in connection with the opening and closing operation of the shutter, and traps the tablets dropping through the passage when the shutter is closed, and a dropping tablet sensor for detecting passage of the tablets dropping through the passage at an upper side of the shutter; and a controller for opening the shutter on the basis of a detection result of the sensor so that the tablets trapped on the shutter drop to be filled into the container.

In the above tablet supply apparatus, the controller may have a counter, count the number of the dropping tablets on the basis of a detection result of the counter and open the shutter on the basis of a count result.

In the above tablet supply apparatus, the controller may further have a timer, start time-counting based on the timer from a time when tablets are discharged from each of the tablet case, and open the shutter when the timer time-counts a predetermined time or the count value of the counter reaches a predetermined number.

In the above tablet supply apparatus, the passage may be configured to extend vertically, and the sensor may comprise a light emitting unit and a photodetecting unit that are disposed so as to face each other through the vertically extending passage and detect tablets passing through the gap between the light emitting unit and the photodetecting unit.

In the above tablet supply apparatus, the predetermined time may be set to be longer than the longest required time among required times which are required from the discharge of tablets from the plural tablet cases till introduction of the tablets into the nozzle.

According to a second aspect of the present invention, there is provided a tablet supply apparatus comprising: a main body having a case accommodating unit at the upper portion thereof; plural tablet cases provided in the case accommodating unit, each of the tablet cases having tablets accommodated therein; a hopper provided at the lower side of the tablet case in the main body; a filling apparatus for filling tablets received by the hopper into a container; and a tablet feeder that is mounted at the inside of an upper portion of the front side of the main body to be horizontally long and discharges tablets put therein to the hopper, wherein the tablet feeder has plural cells that have upwardly-facing open portions and are arranged on a line side by side as a cell array so as to be freely movable along the arrangement direction thereof while tables are accommodated in each of the cells, and a discharge portion that is disposed at one end portion of the cell array and discharges tablets in a cell reaching the one end portion into the hopper.

In the above tablet supply apparatus, the tablet feeder may further have an endless belt that is wound between a pair of shafts and selectively moved in one direction or the other direction of the horizontal direction, the cells may be arranged on the surface of the endless belt which selectively serves as one of an upward-facing surface and a downward-facing surface of the endless belt in connection with the movement of the endless belt, and when a cell on the upward-facing surface of the endless belt reaches the one end portion, the cell concerned may turn over downwardly and tablets put in the cell concerned drop and pass through the discharge portion, whereby the tablets are discharged into the hopper.

According to the present invention, the time required for filling tablets into packaging paper can be shortened. Furthermore, it is unnecessary to ensure an extra space for the tablet feeder as an installation place of the tablet supply apparatus, and the installation work can be facilitated.

BRIEF DESCRIPTION OF THE DRAWINGS

FIGS. 8A and 8B are timing charts showing the operation timing of the tablet supply apparatus when separate packages are prepared, wherein FIG. 8A is a time chart according to a conventional tablet supply apparatus, and FIG. 8B is a time chart according to the tablet supply apparatus of this invention;

DETAILED DESCRIPTION OF THE PREFERRED EMBODIMENTS

Preferred embodiments according to the present invention will be described hereunder with reference to the accompanying drawings.

Figure 1:
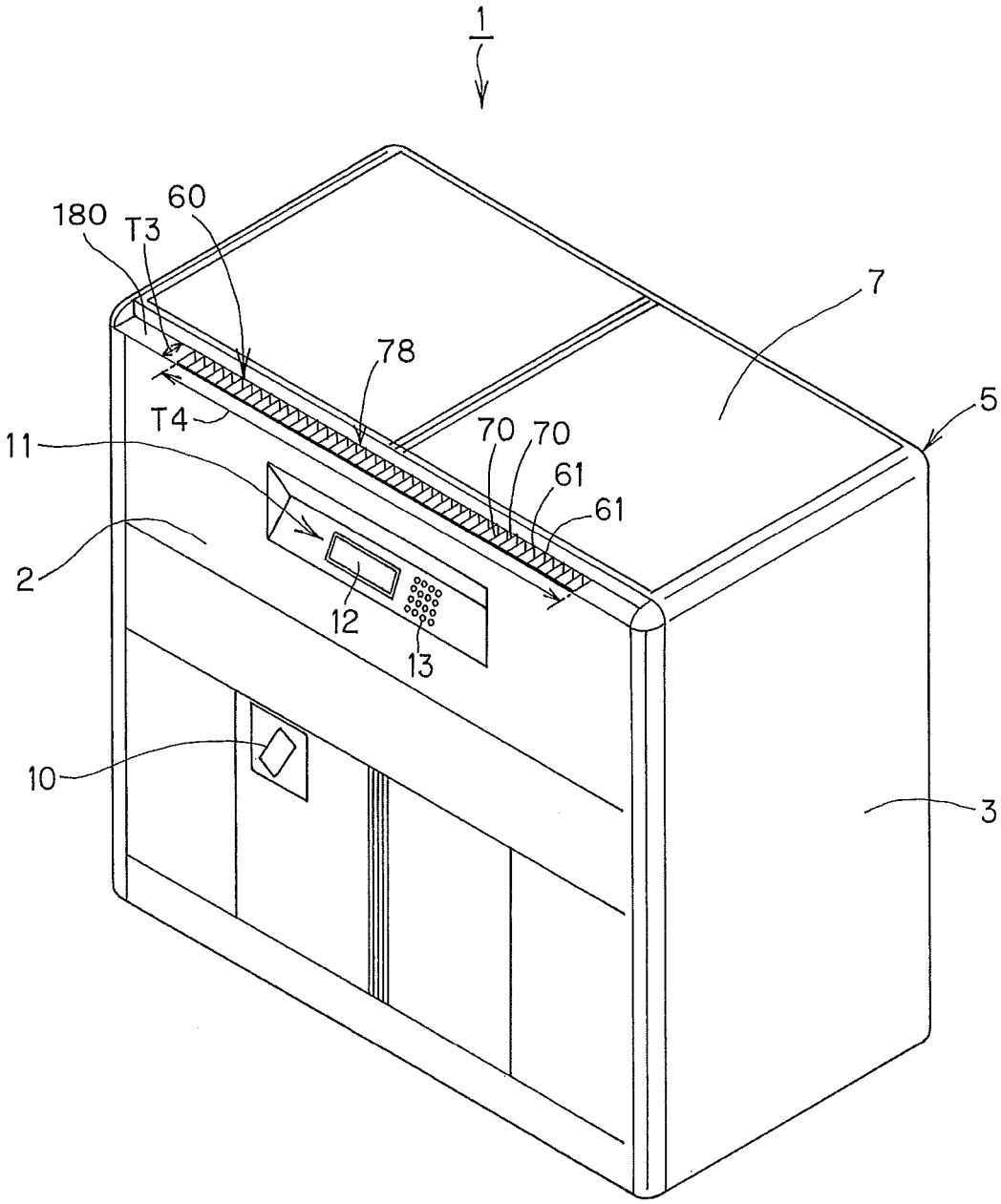
FIG. 1 is a perspective view showing a tablet supply apparatus according to an embodiment of the present invention.
Figure 3:
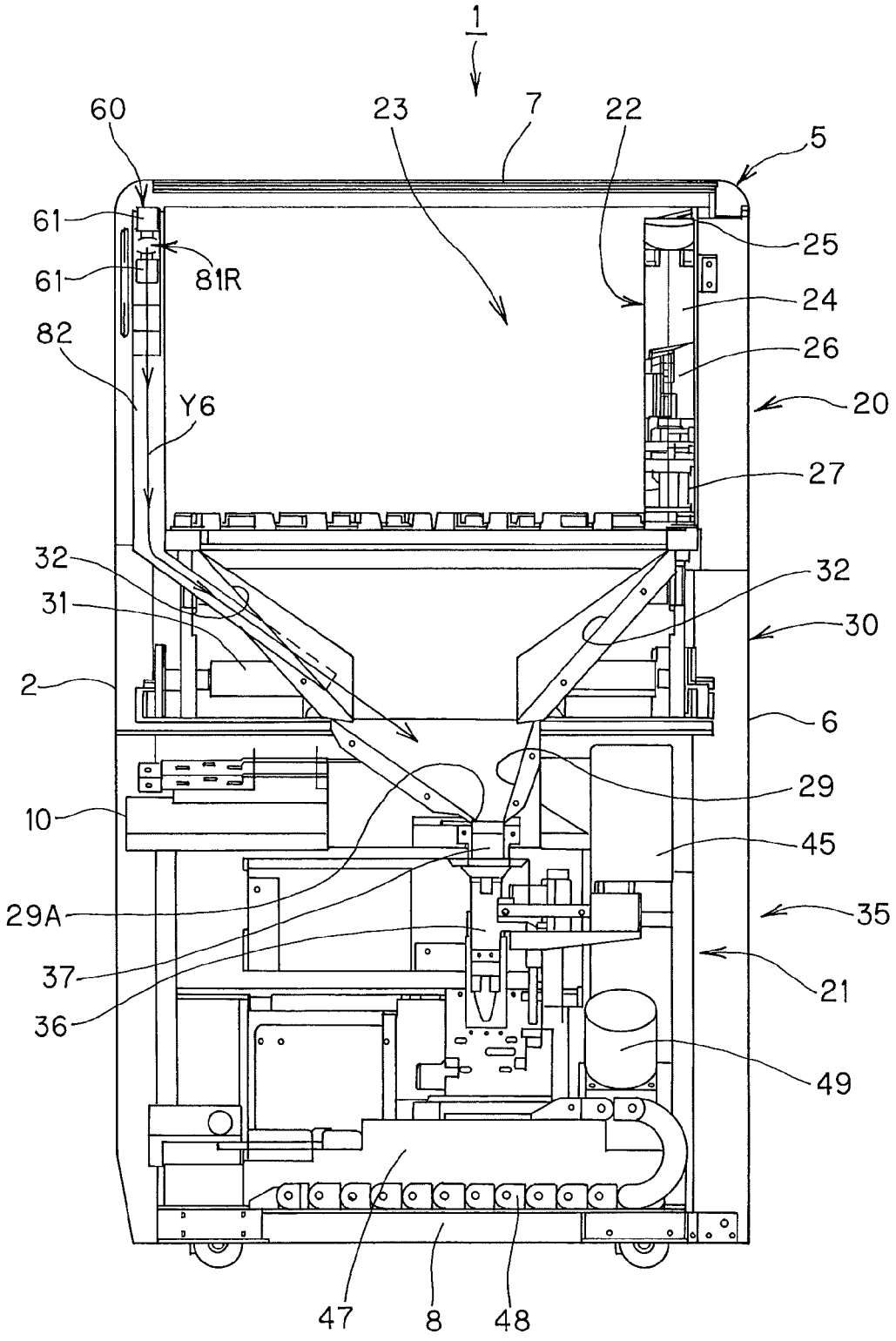
FIG. 3 is a side view showing the tablet supply apparatus of FIG. 1.

FIG. 1 is a perspective view showing a tablet supply apparatus 1 according to an embodiment, FIG. 1 is a front view of the tablet supply apparatus 1 under the state that a front panel 2 is detached, and FIG. 3 is a side view of the tablet supply apparatus 1 under the state that a side panel 3 at the right side in front view is detached. In the following description, the term "tablet" is used as a target to be packaged. However, this term is broadly interpreted so as to cover general medicines such as not only narrowly-defined tablets (small round solid pieces of medicine), but also encapsulated or wrapped powder or liquid medicine, etc. in the following description.

The tablet supply apparatus 1 is installed in a hospital, a dispensing pharmacy or the like. Individual separate packages each of which is filled with predetermined kind and number (amount) of tablets are prepared one by one and supplied by the tablet supply apparatus 1. A personal computer 95 (FIG. 6) is connected to the tablet supply apparatus 1, and the data on the kind and number (amount) of tablets to be filled in a separate package prepared by the tablet supply apparatus 1 are input to the personal computer 95 by the operator.

Figure 2:
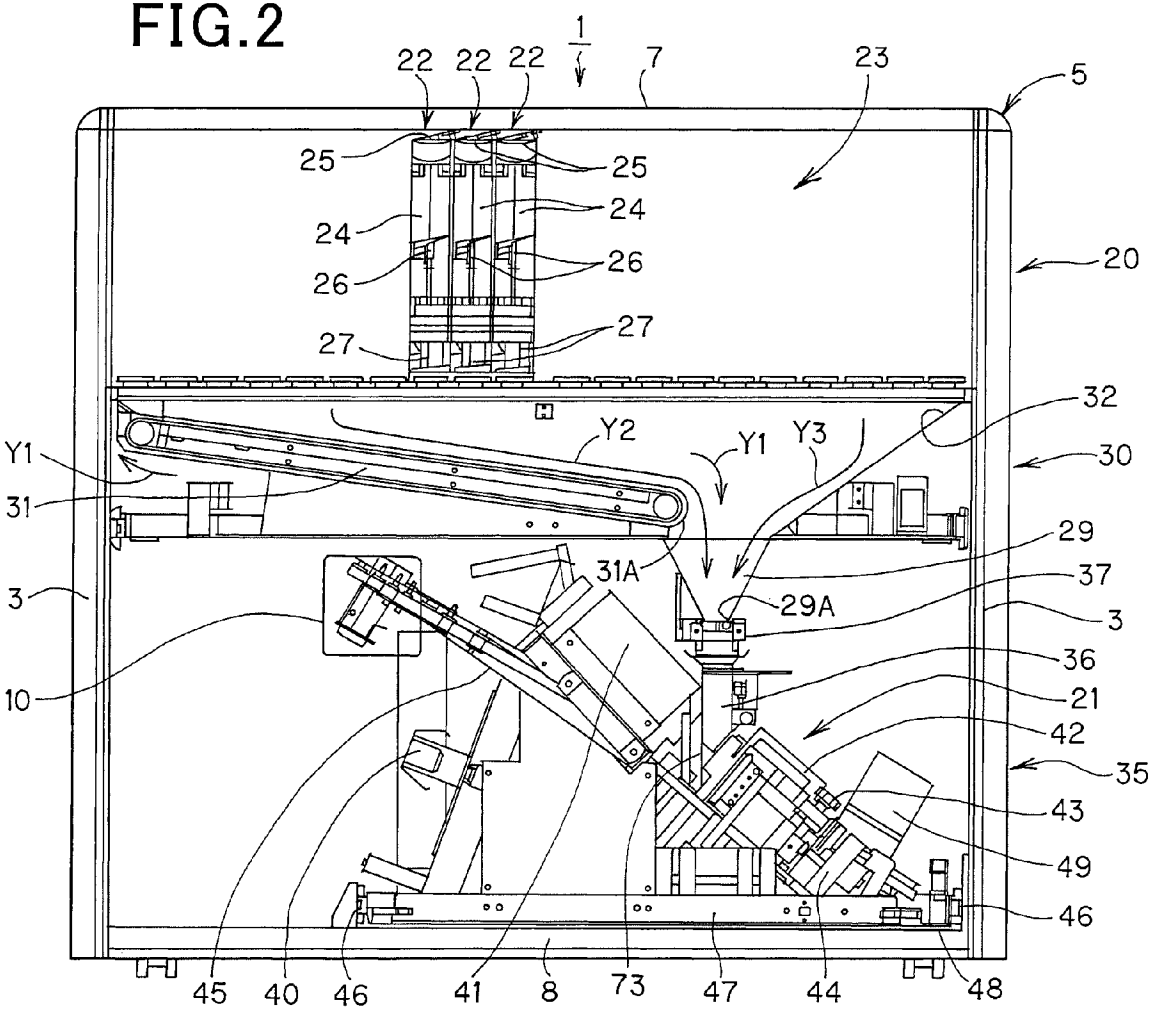
FIG. 2 is a front view showing the tablet supply apparatus of FIG. 1.

As shown in FIGS. 1 to 3, the tablet supply apparatus 1 has a substantially rectangular parallelepiped housing 5, and the housing 5 comprises a front panel 2, a side panel 3, a back panel 6 (FIG. 3), an upper panel 7 and a lower panel 8. As shown in FIG. 1, the front panel 2 is provided with a take-out port 10 from which the operator can take out separate packages prepared by the tablet supply apparatus 1. A control panel 11 is provided to the upper portion of the front panel 2. The control panel 11 has a display unit 12 comprising a liquid crystal display panel, and an input unit 13 having plural operating switches. The operator refers to various kinds of information displayed on the display unit 12, and issues various kinds of instructions to the tablet supply apparatus 1 by operating the operating switches of the input unit 13. The lower portion of the front panel 2 can be opened, and a packaging machine 21 described later can be drawn out from the housing 5 while the lower portion of the front panel 2 is open.

As shown in FIG. 1, a tablet feeder 60 is provided at the upper portion (for example, at the front upper edge of the housing) of the front panel 2. The tablet feeder 60 is used to add the tablet supply apparatus 1 with tablets which are not accommodated in table cases 22 described later, and cells 61 in which the tablets concerned are accommodated are juxtaposed with one another side by side. When tablets which are not accommodated in the table case 22 are added to the tablet supply apparatus 1, the operator puts the tablets concerned at predetermined places of the cells 61. This will be described later.

A tablet supply mechanism portion 20 is provided at the upper portion of the inside of the housing 5. Under the control of a controller 90 described later, the tablet supply mechanism portion 20 discharges predetermined kind and number (amount) of tablets to be filled in each pack. The controller 90 centrically controls the respective parts of the tablet supply apparatus 1, and has a control circuit.

As shown in FIGS. 2 and 3, the tablet supply mechanism portion 20 has a table case accommodating unit 23 for accommodating plural tablet cases 22 in which tablets are accommodated on a kind basis. Each tablet case 22 has a rectangular parallelepiped shape which is elongated in the vertical direction, and plural tablet cases 22 are arranged side by side in the front-and-rear direction and the right-and-left direction in an erected state in the tablet case accommodating unit 23.

The tablet case 22 is opened at the upper end thereof, and a tablet accommodating portion 24 for accommodating tablets is formed so as to intercommunicate with the opening of the tablet case 22. A lid member 25 is provided at the opening so as to be freely opened and closed. When tablets are accommodated in the tablet accommodating portion 24, the lid member 25 is opened to expose the opening, and the tablets are put through this opening into the tablet accommodating portion 24.

An aligning board 26 is provided at the lower side of the tablet accommodating portion 24, and a driving unit 27 is provided below the aligning board 26. The tablets accommodated in the tablet accommodating portion 24 align on the aligning board 26, and fall downwardly from the tablet case 22 one by one according to the swing motion of a swing arm (not shown) provided to the driving unit 27. The driving unit 27 is provided with a tablet detecting sensor 92 (FIG. 6) for detecting tablets falling from the aligning board 26, and the detection value of the tablet detecting sensor 92 is output to a controller.

A tablet introducing unit 30 for introducing tablets falling from the tablet case 22 into the hopper 29 is provided below the tablet supply mechanism portion 20. The tablet introducing unit 30 is provided with a belt conveyor 31 for carrying a tablet falling from a prescribed tablet case 22 to the hopper 29. The belt conveyor 31 rotates in a direction indicated by an arrow Y1 of FIG. 2 to carry tablets falling from the tablet cases 22 located above the belt conveyor 31 to the conveyor end portion 31A. Furthermore, the belt conveyor 31 drops the tablets from the conveyor end portion 31A to the hopper 29, and introduces the tablets into the hopper 29 (see an arrow Y2 of FIG. 2).

Furthermore, the tablet introducing unit 30 is provided with a slope plate 32. This slope plate 32 is inclined downwardly to the left side, and introduces tablets dropping from the tablet cases 22 located above the slope plate 32 into the hopper 29 (see an arrow Y3 of FIG. 2). The tablets dropping from the tablet cases 22 are surely introduced into the hopper 29 by the belt conveyor 31 and the slope plate 32.

In this embodiment, the hopper 29 is disposed so as to be shifted to the right side from the center of the front side. Accordingly, as compared with a case where the hopper 29 is located at the center of the front side, the slope plate 32 has a sharper slope, and thus tablets dropping from the tablet cases 22 located above the slope plate 32 can be surely introduced into the hopper 29 without using any belt conveyor. Therefore, only one belt conveyor may be used in this embodiment.

A packaging machine accommodating unit 35 for accommodating the hopper 29, the packaging machine 21, etc. is provided below the tablet introducing unit 30.

As described above, the tablets dropping from the tablet cases 22 are introduced into the hopper 29. The hopper 29 is broadly opened at the upper surface thereof, and the diameter of the opening portion thereof is gradually reduced in the downward direction. A lower end opening 29A is formed at the lower end of the hopper 29. A nozzle 36 for filling tablets into package paper is joined to the lower end opening 29A through a joint unit 37, and the tablets introduced from the tablets introducing unit 30 into the hopper 29 are discharged through the lower end opening 29A to the nozzle 36, and then filled into the package paper by the nozzle 36. This nozzle 36 will be described later.

In this embodiment, the time period from the time when a tablet is discharged from a tablet case 22 till the tablet concerned is introduced into the nozzle 36 is varied in accordance with the locating position of the tablet case 22 in the tablet case accommodating unit 23. For example, when the time period from the discharge of a tablet from the tablet case 22 which is located at the right end of the front side above the belt conveyor 31 till the introduction of the tablet concerned into the nozzle 37 is compared with the time period from the discharge of a tablet from the tablet case 22 which is located at the left end of the front side above the slop plate 32 till the introduction of the tablet concerned into the nozzle 37, the former time period is longer than the latter time period.

Under the control of the controller 90, the packaging machine 21 prints predetermined characters or images on a package sheet, fills the package sheet with tablets, compartments the package sheet on a separate package basis, cuts the package sheet every pack to continuously prepare separate packages in which desired kinds and numbers (amount) of tablets are respectively filled, and feed the thus-prepared separate packages to the take-out port 10.

As shown in FIG. 2, the packaging machine 21 has a roll 40 around which a thermally adhesive (heat-weldable) package sheet (not shown) is wound, a printer for printing characters or figures on the package sheet, the nozzle 36 described above, a thermal seal head 42 formed of silicon rubber, a roller 43 for feeding a package sheet drawn out from the roll 40, a cutter 44 for cutting the package sheet, and a conveyor 45 for carrying separate packages to the take-out port. Reference numeral 49 represents a motor for driving the conveyor 45.

Here, the basic operation of the packaging machine 21 will be described. The package sheet wound around the roll 40 is substantially V-shaped in section so that the upper surface thereof is opened and it is folded at the lower end thereof. The package sheet is drawn out obliquely, that is, diagonally downward right from the roll 40 by the roller 43 or the like, and then the surface thereof is printed by the printer 41. Subsequently, tablets discharged from the nozzle 36 are filled in the package sheet, and the package sheet is compartmented on a separate package basis by thermal adhesion of the thermal seal head 42. The compartmented and packaged packed package sheet is cut out by a cutter 44, whereby separate packages each of which is filled with predetermined kind and number (amount) of tablets are prepared one by one. The separate packages thus prepared are fed to the take-out port 10 by the conveyor 45.

The packaging machine 21 is mounted on a pedestal 47 which can be freely pulled to the front side through drawing rails 46. Accordingly, the packaging machine 21 can be subjected to maintenance while pulled to the front side. In FIG. 3, reference numeral 48 represents a harness for the packaging machine 21 which is freely detachably connected between the packaging machine 21 and the lower structure 7B through a connector, and it is so long that the pullout amount of the packaging machine 21 can be sufficiently permitted.

Next, the nozzle 36 will be described.

Figure 4:
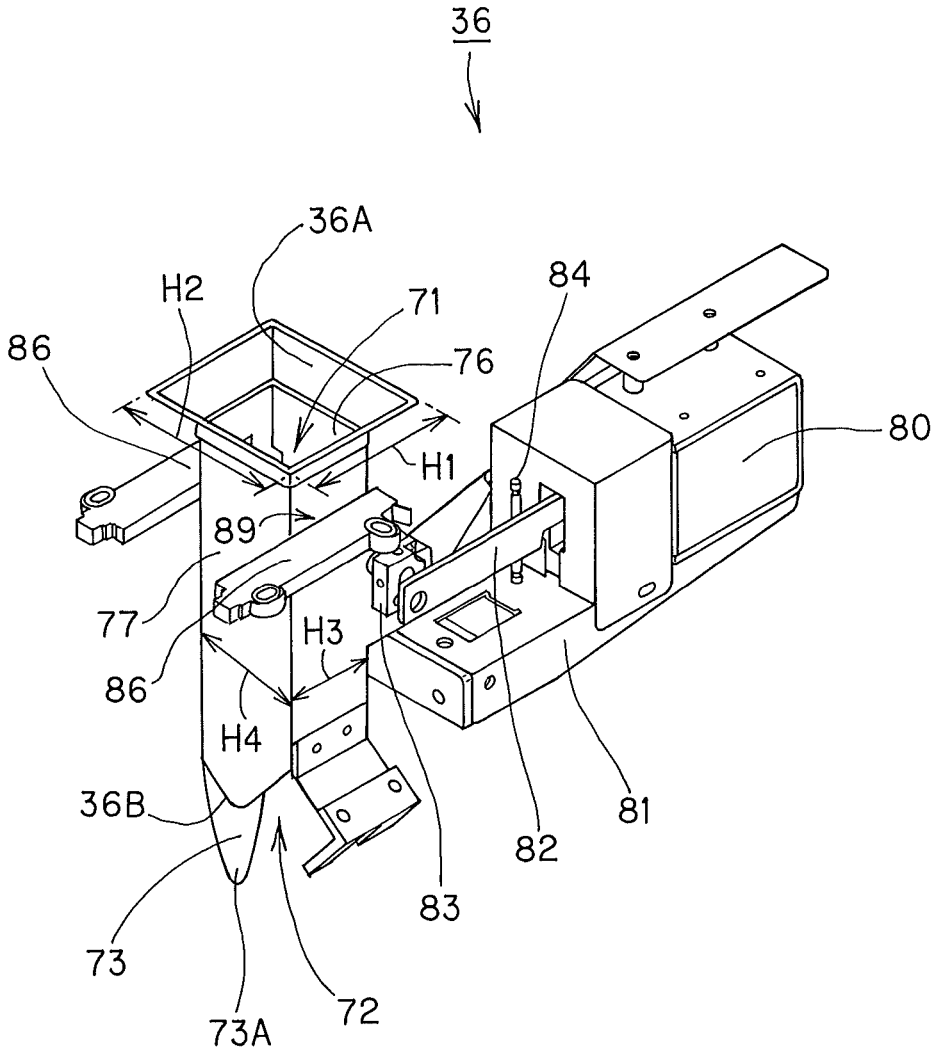
FIG. 4 is a perspective view showing a nozzle and surrounding parts around the nozzle.
Figure 5:
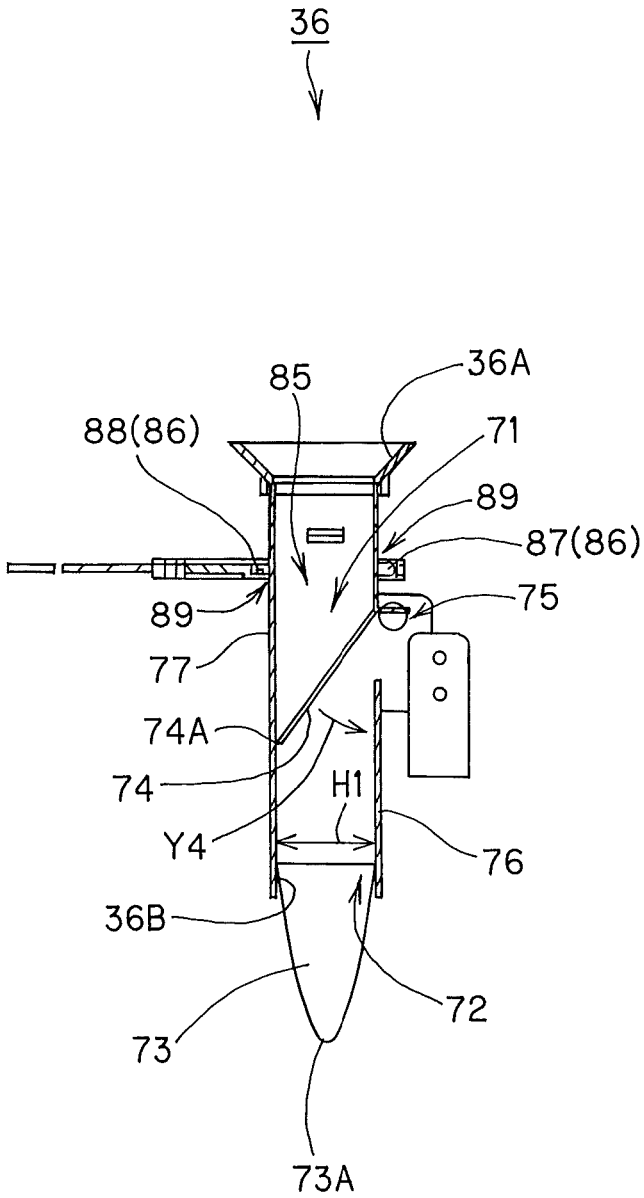
FIG. 5 is a cross-sectional view of the nozzle.

FIG. 4 is a perspective view of the nozzle 36 and peripheral parts thereof, and FIG. 5 is a cross-sectional view of the nozzle 36.

The nozzle 36 is joined to the lower-end opening 29A of the hopper 29, and provided substantially vertically. The nozzle 36 is provided with an upper opening 36A at the upper end thereof and also a lower opening 36B at the lower end thereof. The nozzle 36 is designed in a rectangular and tubular shape to be opened at the upper and lower ends thereof. A tablet exit portion 72 as an exit for tablets dropping in a tablet drop passage formed in the nozzle 36 is formed at the lower-end opening 36B. The tablet drop passage 71 is a space intercommunicating between the upper-end opening 36A and the lower-end opening 36B in the nozzle 36, and formed so as to extend in the vertical direction. One side H1 and the other side H2 of the upper-end opening 36A are set to be longer than one side H3 and the other side H4 of the tablet drop passage 71 respectively, so that tablets discharged from the lower-end opening 29A of the hopper 29 are easily introduced into the tablet drop passage 71. Furthermore, the one side H1 and the other side H2 of the upper-end opening 36A are substantially equal to each other, so that the upper-end opening 36A is shaped to be similar to a square. Accordingly, tablets having various shapes easily drop into the tablet drop passage 71.

A packaging sheet guide 73 is provided at the tablet exit portion 72. The packaging sheet guide 73 has a tapered tip 73A which is substantially V-shaped in front view. The packaging sheet guide 73 is oriented to be orthogonal to the travel direction of the packaging sheet (the direction from the upper left side to the lower right side in FIG. 2), and also it is located at an upstream side in the travel direction of the packaging sheet as shown in FIG. 3.

When tablets are filled from the nozzle 36 into the packaging sheet, the nozzle 36 is inserted into the packaging sheet through the packaging sheet guide 73. Tablets inserted from the hopper 29 into the nozzle 36 are passed through the tablet drop passage 71, discharged from the tablet exit portion 72 and then filled into the packaging sheet. Here, the packaging sheet guide 73 is V-shaped, and thus the packaging sheet guide 73 is easily inserted from the upper-surface opening of the packaging sheet which is designed to have a substantially V-shaped section. The packaging sheet is formed by folding longitudinally-extending packaging paper in half along the center line thereof in the longitudinal direction thereof so that the upper surface thereof is opened.

When the packaging sheet guide 73 is inserted in the packaging sheet, the packaging sheet is made to expand by the packaging sheet guide 73, so that a large amount of medicine (many tablets) can be smoothly filled in the packaging sheet.

As shown in FIG. 5, a shutter 74 for opening/closing the tablet drop passage 71 is provided in the nozzle 36. The shutter 74 is provided substantially at the center in the vertical direction of the tablet drop passage 71, and designed to be freely swingable around the swing center portion 75 under the control of the controller 90.

As shown in FIG. 5, this shutter 74 closes the tablet drop passage 71 under the state that the tip portion 74A thereof extends obliquely downwardly to a wall 77 facing a wall 76 on which the swing center portion 75 is located (close state). At this time, the tip portion 74A abuts against the wall 77 or it is proximate to the wall 77. Under this close state, the tablet drop passage 71 is closed by the shutter 74, and the tablets introduced into the nozzle 36 are trapped on the shutter 74.

The shutter 74 swings in the direction of an arrow Y4 of FIG. 5 around the swing center portion 75, thereby opening the tablet drop passage 71 (open state). Under this open state, the tablets drops through the tablet drop passage 71 without being disturbed by the shutter 74.

In FIG. 4, reference numeral 80 represents a solenoid for driving the shutter 74, and it is secured to the base 81. The swing center portion 75 of the shutter 74 is fixed to a link member 83 which is freely swingably secured to an arm 82 secured to a plunger (not shown) of the solenoid 80. A coil spring (not shown) is wound between a ball 84 secured to the base 81 and the link member 83, and urges the plunger at all times so that the plunger projects. When the solenoid 80 is controlled by the controller 90 to retract the plunger against the coil spring, the shutter 74 is swung in the direction of the arrow Y4 of FIG. 5 through the swing center portion 75 to be set to the close state. The shutter 74 is set to the close state by the urging force of the coil spring while the shutter 74 is not set to the open state by the controller 90.

As shown in FIG. 5, the nozzle 36 is provided with a dropping tablet detecting sensor 86 for detecting the number of dropping tablets through the tablet drop passage 71 of the nozzle 36. This dropping tablet detecting sensor 86 comprises a light emitting unit 87 having a light emitting element for emitting light, and a photodetecting unit 88 having a phototransistor for receiving light emitted from the light emitting unit 87, and the light emitting unit 87 and the photodetecting unit 88 are disposed so as to face each other through the tablet drop passage 71. The dropping tablet detecting sensor 86 detects tablets passing (dropping) in a space 85 between the light emitting unit 87 and the photodetecting unit 88 in the tablet drop passage 71, and outputs this detection value to the controller 90. As described later, the controller 90 counts the number of tablets dropping through the tablet drop passage 71 on the basis of the detection value input from the dropping tablet detecting sensor 86. In this embodiment, as shown in FIG. 5, the dropping tablet detecting sensor 86 is provided in the tablet drop passage 71 extending in the vertical direction, and the tablets dropping in the vertical direction in the tablet drop passage 71 can be surely detected by the dropping tablet detecting sensor 86.

Figure 6:
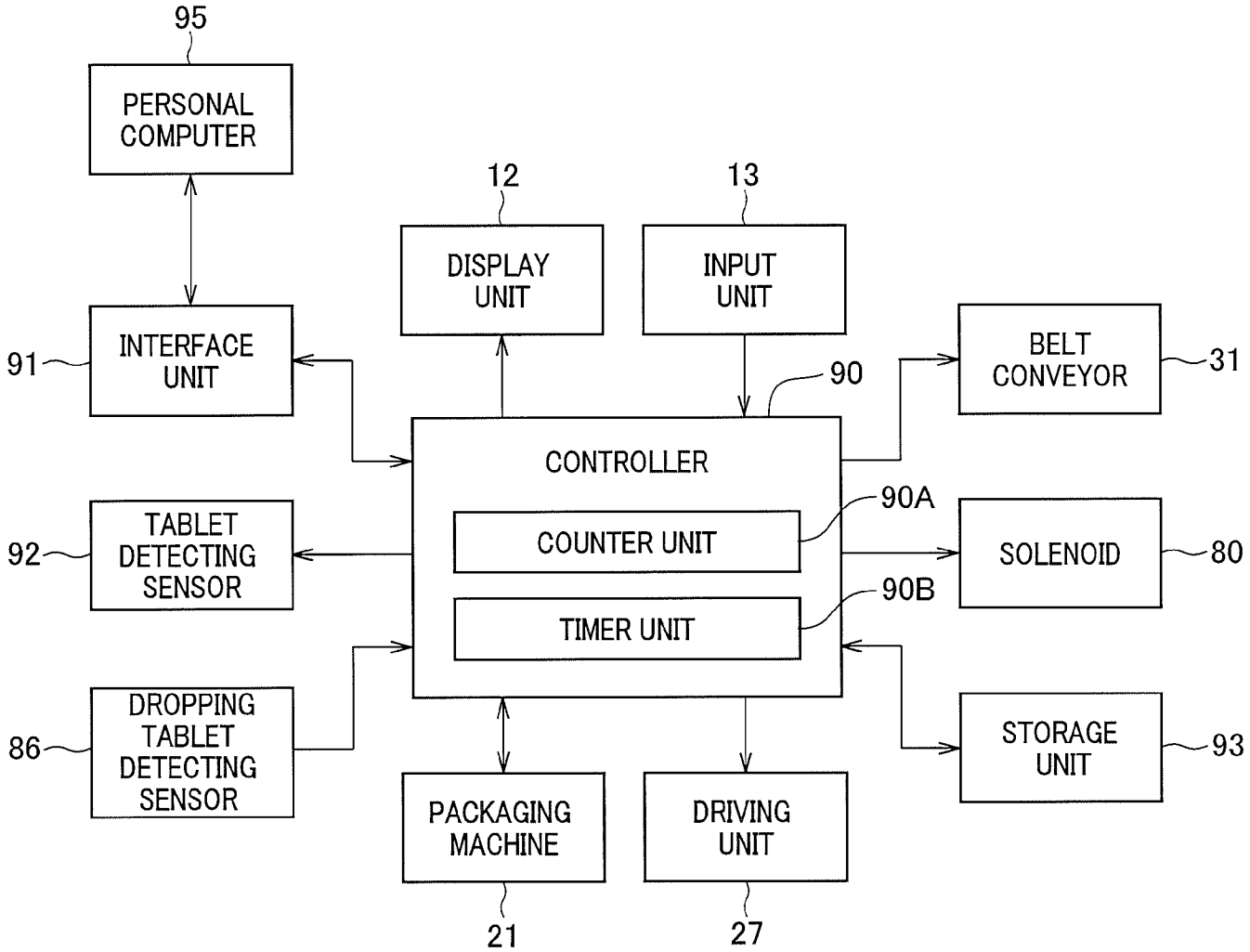
FIG. 6 is a block diagram showing the functional construction of the tablet supply apparatus.

FIG. 6 is a block diagram showing the functional construction of the tablet supply apparatus 1.

The controller 90 concentrically controls the respective parts of the tablet supply apparatus 1, and has CPU (Central Processing Unit) as operation executing means, ROM (Read Only Memory) for storing a basic control program executed by CPU and storing data associated with the basic control program, etc. in a non-volatile style, RAM (Random Access Memory) for temporarily storing programs executed by CPU, data associated with the programs, etc., and other peripheral circuits. The controller 90 executes various kinds of counting operations on the basis of a reference clock generated by an oscillator (not shown) and time-counting of the present time. The controller 90 has a counter unit 90A and a timer unit 90B.

The counter unit 90A counts the number of tablets dropping in the tablet drop passage 71 on the basis of the detection value of the dropping tablet detecting sensor 86.

The timer unit 90B time-counts a tablet collection time D1 described later.

The controller 90 is connected to the packaging machine 21, the driving unit 27, the belt conveyor 31, the solenoid 80, the interface unit 91, the tablet detecting sensor 92, the dropping tablet detecting sensor 86, the display unit 12, the input unit 13 and the storage unit 93.

Under the control of the controller 90, the packaging machine 21 prepares separate packages filled with predetermined tablets and feeds the prepared separate packages to the take-out port 10 through the conveyor 45.

Under the control of the controller 90, the driving unit 27 swings a swing arm provided to the driving unit 27, and downwardly drops tablets from the tablet case 22 one by one.

Under the control of the controller 90, the belt conveyor 31 rotates in the direction of an arrow Y1 of FIG. 2 to feed tablets dropping from the tablet cases 22 located above the belt conveyor 31 to the conveyer end portion 31A. Furthermore, the belt conveyor 31 drops the tablets from the belt conveyor 31A to the hopper 29 and introduces the tablets into the hopper 29.

Under the control of the controller 90, the solenoid 80 sets the shutter 7 under the close state to the open state, whereby the tablets which are temporarily trapped on the shutter 74 are discharged through the tablet exit portion 72 to the packaging machine.

The interface unit 91 is connected to the personal computer 95 through a signal communication cable or the like, and under the control of the controller 90, the interface unit 91 transmits/receives various kinds of signals to/from the personal computer 95. According to the above construction, various kinds of data can be transmitted/received between the personal computer 95 and the tablet supply apparatus 1, and also the operator can execute various kinds of instructions to the tablet supply apparatus 1 through the personal computer 95.

The tablet detecting sensor 92 detects the tablets discharged from the tablet cases 22*a* and outputs the detection result to the controller 90. The controller 90 counts the number of the tablets discharged from the tablet cases 22 on the basis of the detection result input from the tablet detecting sensor 92.

The dropping tablet detecting sensor 86 detects tablets passing (dropping) between the light emitting unit 87 and the photodetecting unit 88 in the tablet drop passage 71, and outputs the detection value to the controller 90. The counter unit 90A of the controller 90 counts the number of the tablets dropping in the tablet drop passage 71 on the basis of the detection value input from the dropping tablet detecting sensor 86.

Under the control of the controller 90, the display unit 12 displays various kinds of information. The input unit 13 accepts a user's input operation and outputs it to the controller 90.

The storage unit 93 is constructed by EEPROM or a flash memory, and stores various kinds of data so that the data rewritable under the control of the controller 90.

The thus-constructed tablet supply apparatus 1 executes the following operation to fill tablets into the packaging sheet and shorten the working time for preparing separate packages.

The operation of the tablet supply apparatus 1 will be described with reference to a flowchart.

Figure 7:
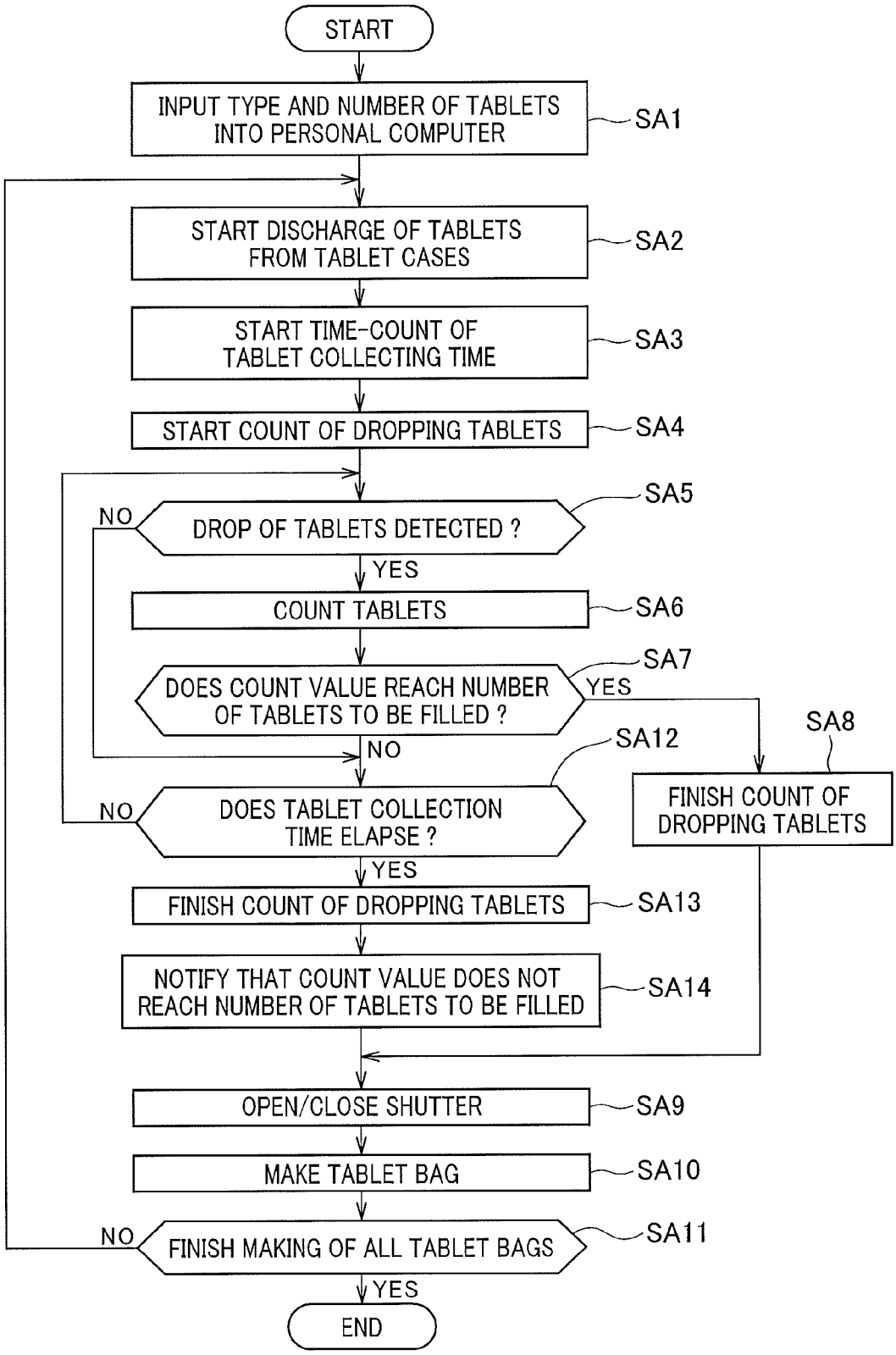
FIG. 7 is a flowchart showing the operation of the tablet supply apparatus.

FIG. 7 is a flowchart showing the operation of the tablet supply apparatus 1 when separate packages are prepared.

Before preparation of separate packages, the operator inputs information representing the kind and number (amount) of tablets to be filled in each pack to the personal computer 95 (step SA1). The data representing the information input to the personal computer are output to the controller 90 through the interface unit 91, and the controller 90 stores the data concerned as filling tablet data to the storage unit 93. The tablet supply apparatus 1 continuously prepare separate packages on the basis of this filling tablet data.

After the input to the personal computer 95 by the operator, the controller 90 starts to discharge predetermined kind and number (amount) of tablets from the tablet cases 22 (step SA2). Specifically, the controller 90 refers to the filling tablet data to specify a tablet case 22 in which tablets to be filled in each pack to be prepared are accommodated, and controls the driving unit 27 to drop the tablets downwardly from the specified tablet case 22 one by one. At this time, the tablet detecting sensor 92 detects the tablets discharged from the tablet case 22 and also outputs the detection value to the controller 90. The controller 90 counts the number (amount) of the tablets discharged from the tablet case 22 on the basis of the detection value input from the tablet detecting sensor 92, and controls the driving unit 27 to stop the drop of the tablets at the stage that the predetermined number (amount) of the tablets are discharged.

After all the tablets are discharged from the tablet case 22 in step SA2, the timer unit 90B of the controller 90 starts the time of the tablet collection time D1 (step SA3). Here, the tablet collection time D1 will be described.

Here, the time period from the time when a tablet is discharged from some tablet case 22 till the time when this tablet is introduced through the tablet introducing unit 30 and the hopper 29 into the nozzle 36 will be referred to as "nozzle collection time". The tablet collection time D1 is set to be longer than the nozzle collection time of a table case 22 located at a location place where the nozzle collection time is longest among the plural tablet cases 22. For example, when the nozzle collection time of the tablet case 22 for which the nozzle collection time is longest is equal to 10 seconds, the tablet collection time D1 is set to 15 seconds. Accordingly, when a tablet is discharged from a tablet case 22 is discharged and then the tablet collection time D1 elapses, the tablet discharged from the tablet case 22 is surely introduced into the nozzle 36.

Furthermore, after all the tablets are discharged from the tablet case 22 in step SA2, the counter unit 90A of the controller 90 starts to count the number of tablets dropping in the tablet drop passage 71 of the nozzle 36 (step SA4).

Subsequently, the controller 90 determines on the basis of the detection value of the dropping tablet detecting sensor 86 whether drop of a tablet is detected (step SA5). When the drop of a tablet is detected (step SA5: YES), the counter unit 90A of the controller 90 counts the number of drop-detected tablets (step SA6), and refers to the filling tablet data to determine whether the counted table number reaches the number of tablets to be filled in the pack concerned (step SA7). When the counted tablet number reaches the number of tablets to be filled in the pack (step SA7: YES), all the tablets to be filled in the pack are introduced into the nozzle 36. Therefore, the controller 90 finishes the count of the number of tablets dropping in the tablet drop passage 71 of the nozzle 36 (step SA8), and controls the solenoid 80 to set the shutter 74 to the open state and thus drop the tablets trapped on the shutter 74, so that the tablets are filled in the packaging sheet through the tablet exit portion 72 (step SA9). After the tablets are filled in the packaging sheet, the controller 90 controls the packaging machine 21 to compartment the packaging sheet filled with the tablets every package, cut the packaging sheet every package to prepare separate packages each of which is filled with desired kind and number (amount) of tablets (medicine), and then feed the prepared separate packages to the take-out port (step SA10). Subsequently, the controller 90 determines whether the preparation of all the separate packages is finished (step SA11). When it is not finished (step SA11: NO), the processing returns to step SA2, and when it is finished (step SA11: YES), the processing is finished.

On the other hand, when no tablet drop is detected in step SA5 (step SA5: NO), or when the counted tablet number does not reach the number of tablets to be filled in a separate package in step SA7 (step SA7: NO), the controller 90 determines whether the tablet collection time D1 elapses or not (step SA12). When the tablet collection time D1 does not elapse (step sA12: NO), the controller returns the processing to step SA5, and determines again whether tablet drop is detected or not. On the other hand, when the tablet collection time D1 elapses (step SA12: YES), the controller 90 finishes the count of the number of tablets dropping in the tablet drop passage 71 of the nozzle 36 (step SA13). In this step SA13, the tablet number counted by the counter unit 90A does not reach the number of tablets to be filled in a separate package irrespective of the lapse of the tablet collection time D1.

Here, there is a case where the tablet number counted by the counter unit 90A does not reach the number of tablets to be filled in a separate package irrespective of the lapse of the tablet collection time D1 because plural tablets drop simultaneously between the photodetector unit 88 and the light emitting unit 87 while overlapped with one another, and thus these plural tablets are erroneously detected as one tablet. In this case, the tablet number counted by the counter unit 90A does not reach the number of tablets to be filled in a separate package. In consideration of this, according to this embodiment, when the tablet collection time D1 in which the tablets discharged from the tablet case 22 are surely introduced into the nozzle 36 elapses, the count of the tablet number is finished even when the tablet number counted by the counter unit 90A does not reach the number of tablets to be filled in a separate package.

After the count of the number of dropping tablets in step SA13 is finished, the controller 90 controls the display unit 12 to display that the tablet number counted by the counter unit 90A does not reach the number of tablets to be filled in a separate package, and notifies this fact to the operator (step SA14). On the basis of this information, the operator recognizes that a separate package is prepared under the state that the counted tablet number does not reach the number of tablets to be filled in the pack, and also checks the content of the pack. In step SA14, the controller 90 may input some sign into the pack concerned and promote the operator to check it.

After the notification, the controller 90 controls the solenoid 80 to set the shutter 74 to the open state, and drops the tablets trapped on the shutter 74 to fill the tablets into the packaging sheet through the tablet exit portion 72 (step SA9). After the packaging sheet is filled with the tablets, the controller 90 controls the packaging sheet 21 to compartment and cut the packaging sheet filled with the tablets every package, thereby preparing separate packages each of which is filled with desired kind and number (amount) of tablets, and then feeds these separate packages to the take-out port 10 (step SA10). Subsequently, the controller 90 determines whether the preparation of all the separate packages is finished (step SA11). When it is not finished (step SA11: NO), the controller 90 returns the processing to the step SA2, and when it is finished (step SA11: YES), the controller 90 finishes the processing.

Figure 8A:
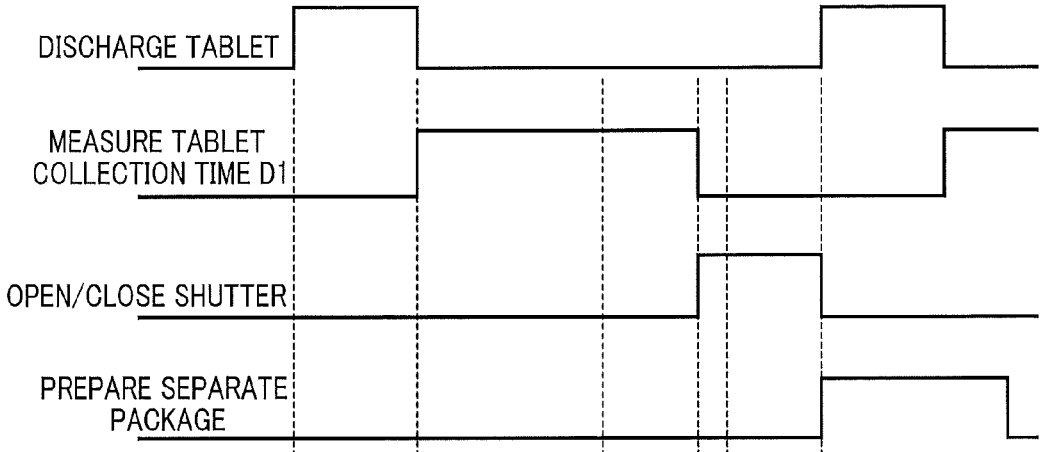
Figure 8B:
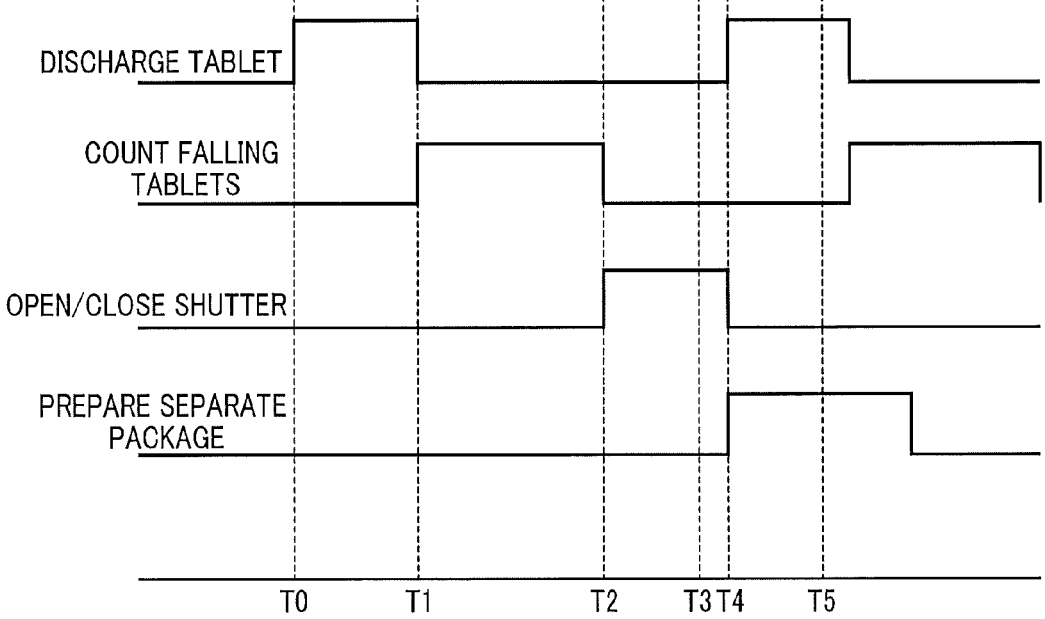

FIG. 8 is a timing chart when separate packages are continuously prepared. In FIG. 8, (A) represents the timing chart when separate packages are prepared by using a conventional tablet supply apparatus, and (B) represents the timing chart when separate packages are prepared by using the tablet supply apparatus 1 according to this embodiment.

First, the operation timing of the conventional tablet supply apparatus will be described with reference to (A) of FIG. 8.

As shown in (A) of FIG. 8, prescribed tablets are discharged from the tablet case 22 at a lapse time T0, and the discharge of the prescribed tablets is finished at a lapse time T1. After the discharge of the tablets, the time-count of the tablet collection time D1 is started, and the tablet collection time D1 elapses at a lapse time T3. As described above, at the time point when the tablet collection time D1 elapses, the tablets discharged from the tablet case 22 are surely introduced into the nozzle 36. The shutter 74 is set to the open state at the lapse time T3 at which the tablet collection time D1 elapses, and the shutter 74 is set to the close state at a lapse time T5 at which a predetermined time elapses. The preparation of separate packages is started by using the packaging sheet filled with tablets from the nozzle 36 is started at the lapse time T5, and also tablets to be filled in the next separate package is discharged from the tablet case 22.

Next, the operation timing of the tablet supply apparatus 1 according to the embodiment will be described with reference to (B) of FIG. 8.

As shown in (B) of FIG. 8, predetermined tablets are discharged from the tablet case 22 at the lapse time T0, and the discharge of the predetermined tablets is finished at the lapse time T1. After the discharge of the tablets is finished, the number of tablets dropping in the tablet drop passage 71 of the nozzle 36 is counted, and the count concerned is finished at the stage that the counted tablet number reaches the number of tablets to be filled in a separate package at the time T2. The tablets discharged from the tablet case 22 is introduced into the nozzle 36 at a time earlier than the tablet collection time D1, and thus the count finishing time T2 is earlier than the lapse time T3 at which the tablet collection time D1 in (A) of FIG. 8 elapses.

At the time T2 at which the count of the dropping tablets is finished, the shutter 74 is set to the open state, and at the lapse time T4 at which a predetermined time elapses, the shutter 74 is set to the close state. At the lapse time T4, the preparation of a separate package is started by using a packaging sheet filled with tablets from the nozzle 36, and tables to be filled in a next separate package are discharged. Here, as is apparent from the comparison between (A) and (B) of FIG. 8, in the tablet supply apparatus 1 according to this embodiment, the next tablets are discharged from the tablet case at the lapse time T4 which is earlier than the lapse time T5 corresponding to the discharge timing of the tablet case in the conventional tablet supply apparatus, and thus the separate package preparing time is shortened.

As described above, according to this embodiment, the nozzle 36 is equipped with the shutter 74 for temporarily trapping tablets, the dropping tablet detecting sensor 86 for detecting the tablets passing through the tablet drop passage 71 of the shutter 74, and the controller 90 for opening the shutter 74 in accordance with the detection result of the dropping tablet detecting sensor 86.

With this construction, when a separate package is prepared, the shutter 74 is set to the open state. Accordingly, when the tablets introduced into the nozzle 36 are filled in the packaging sheet, the shutter 74 is set to the open state at the time point when a predetermined number of tablets is counted from the discharge of tablets from the tablet case 22 without waiting for the lapse of the tablet collection time D1, and the next tablets can be discharged from the tablet case 22. Accordingly, as shown in the timing chart of FIG. 8, the time required to perform the working of preparing a separate package can be shortened as compared with the conventional tablet supply apparatus 1.

Furthermore, in this embodiment, the counter unit 90A of the controller 90 counts the number of tablets dropping in the tablet drop passage 71 of the nozzle 36 on the basis of the detection value of the dropping tablet detecting sensor 86. With this construction, when the tablet number counted by the counter unit 90A of the controller 90 reaches a predetermined number, the shutter 74 can be set to the open state. Accordingly, as described above, the time required for the work of preparing a separate package(s) can be shortened.

Furthermore, according to this embodiment, after the tablets are discharged from the tablet case 22, the timer unit 90B of the controller 90 measures the tablet collection time D1. When the tablet number counted by the counter unit 90A does not reach the number of tablets to be filled in a separate package in spite of the lapse of the tablet collection time D1, the shutter 74 is set to the open state to fill tablets from the nozzle 36 into a packaging sheet.

Here, there is a case where the tablet number counted by the counter unit 90A does not reach the number of tablets to be filled in the separate package in spite of the lapse of the tablet collection time D1 because plural tablets simultaneously drop between the photodetecting unit 88 and the light emitting unit 87 while overlapped with one another and thus the plural tablets are erroneously detected as one tablet. In this case, the tablet number counted by the counter unit 90A does not reach the number of tablets to be filled in the separate package. In consideration of this, in the case where the tablet collection time D1 at which the tablets discharged from the tablet case 22 are surely introduced into the nozzle 36 elapses, the count of the number of tablets is finished and the shutter 74 is set to the open state even when the table number counted by the counter unit 90A does not reach the number of tablets to be filled in the separate package. Accordingly, there can be prevented such a situation that no separate package is prepared although all the tablets to be filled in the separate package are introduced in the nozzle 36.

Furthermore, in this embodiment, the dropping tablet detecting sensor 86 is provided in the tablet drop passage 71 extending in the vertical direction. Accordingly, tablets dropping downwardly in the vertical direction in the tablet dropping passage 71 can be surely detected by the dropping tablet detecting sensor 86.

Furthermore, in this embodiment, the time from the discharge of a tablet from the tablet case 22 till the introduction of the tablet concerned into the nozzle 36 is varied in accordance with the position of the tablet case 22 in the tablet case accommodating unit 23. For example, the time from the discharge of a tablet from a tablet case 22 located above the belt conveyor and at the right end of the front side till the introduction of this tablet into the nozzle 37 is longer than the time from the discharge of a tablet from a tablet case 22 located above the slope plate 32 and at the left end of the front side till the introduction of this tablet into the nozzle 37. In this construction, by executing the operation shown in the flowchart of FIG. 7, the time required to prepare a separate package can be shortened as shown in the timing chart of FIG. 8.

Next, the tablet feeder 60 will be described.

Figure 9A:
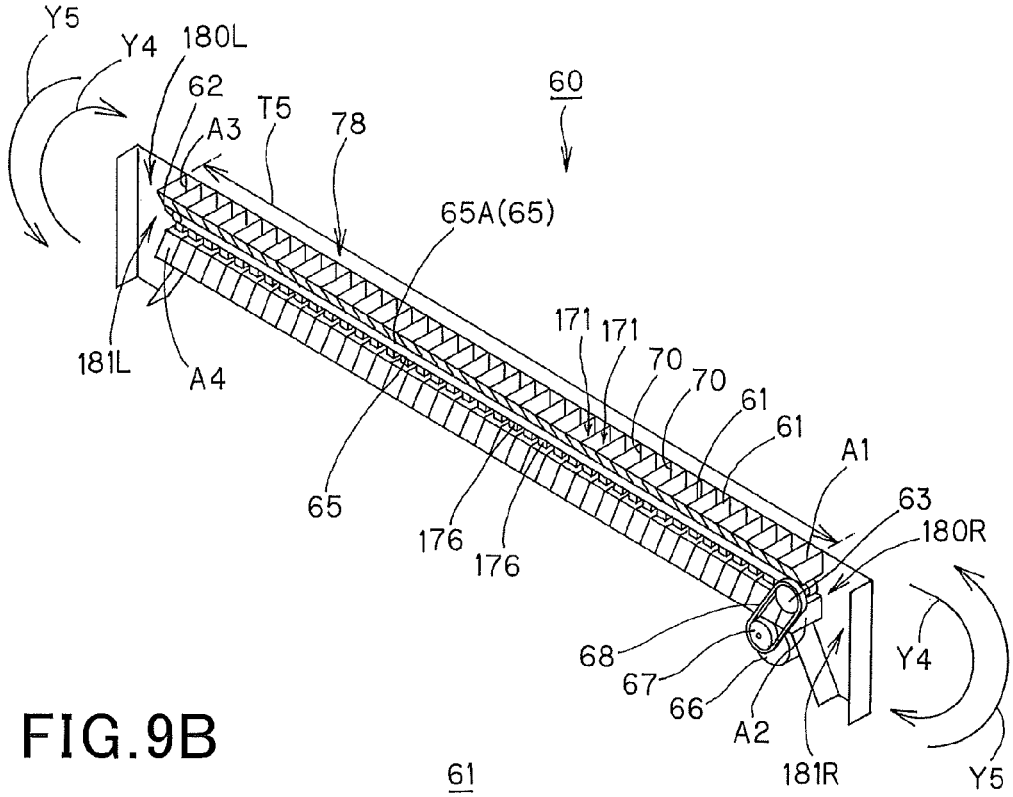
FIG. 9A is a perspective view of a tablet feeder.
Figure 9B:
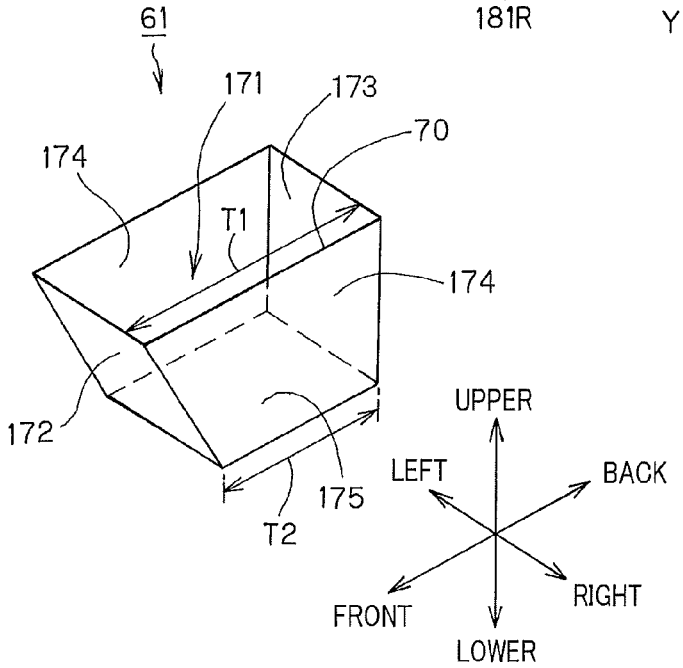
FIG. 9B is a perspective view of a cell.

FIG. 9A is a perspective view showing the tablet feeder 60 having cells 61, and FIG. 9B is a perspective view showing a cell of the tablet feeder 60.

When there are tablets which are to be filled in some separate package, but are not set in any tablet case (hereinafter referred to as "deficient tablets", the tablet feeder 60 is used to add the tablets concerned to the tablet supply apparatus 1. More specifically, the tablet feeder 60 is used to introduce tablets put thereto into the hopper 29 at a predetermined timing.

As shown in FIGS. 9A and 9B, the tablet feeder 60 has an endless belt 65 which is wound between a shaft 62 provided at the left side in front view and a driven pulley 63 provided at the right side in front view and moved in a horizontal direction according to the motion of the driven pulley 63. A driving pulley 67 joined to the output shaft of the driving motor 66 is connected to the driven pulley 63 through a belt 68. The driven pulley 63 is rotated in accordance with the driving of the driving motor 66, and the endless belt 65 is moved in accordance with the motion of the driven pulley 63. The driving motor 66 is designed to be rotatable forwardly and reversely. The endless belt 65 is moved in the direction of an arrow Y4 of FIG. 9A or in a direction of an arrow Y5 of FIG. 9B. In this embodiment, by operating the input unit 13, the operator can select to move the endless belt 65 in the direction of the arrow Y4 or in the direction of the arrow Y5.

Plural cells 61 are provided on the surface of the endless belt 65. As shown in FIG. 9B, the cell 61 is designed in a substantially box-shape having an opening 70 at the upper surface thereof, and it has a tablet accommodating unit 171 in which tablets are accommodated, and a front surface 172, a back surface 173, side surfaces 174 and a bottom surface 175. In FIG. 9B, the front and rear directions, the right and left directions and the upward and downward directions are defined as indicated by arrows in FIG. 9B for simplification of the description. The length T of one side of the opening 70 in the front-and-rear direction is set to be longer than the length T2 of one side of the bottom surface 175 in the front-and-rear direction. The cell 61 is designed to be more widely opened in the upward direction, so that tablets can be more easily accommodated through the opening 70 in the tablet accommodating unit 171. Furthermore, the front surface 172 is gradually downwardly inclined toward the rear side, and this inclination makes it easily to accommodate tablets in the tablet accommodating unit 171. Each cell 61 is secured to the surface of the endless belt 65 through a joint member 176 for joining the bottom surface 175 of the cell 61 and the surface of the endless belt 65.

As shown in FIG. 9A, the cells 61 are disposed side by side on a line on the surface of the endless belt 65. Specifically, the respective cells 61 are secured to the overall surface of the endless belt 65 so as to be aligned with one another side by side so that the side surfaces thereof face one another. In this case, the endless belt 65 is wound between the shaft 62 and the driven pulley 63, and the cells 61 are arranged on the endless belt 65. The surface of the endless belt on which the cells 61 are arranged selectively serves as one of an upwardly-facing surface and a downwardly-facing surface of the endless belt in connection with the movement of the endless belt.

Here, an array of cells 61 which are arranged side by side on the upward-facing surface 65A of the endless belt 65 will be referred to as "upward-facing array" and also an array of cells 61 which are arranged side by side on the downwardly-facing surface of the endless belt 65 will be referred to as "downward-facing array". Accordingly, the cells 61 constituting the upward-facing array (downward-facing array) are changed in connection with the rotation of the endless belt 65. The cells 61 of the upward-facing array arranged on the upward-facing surface 64A of the endless belt 65 are opened upwardly. On the other hand, the cells 61 of the downward-facing array arranged on the downward-facing surface of the endless belt 65 are opened downwardly. Here, the plural cells 61 which are located on the upward-facing surface 65A of the endless belt 65 and upwardly opened constitute a deficient tablet putting unit 78 in which the operator puts deficient tablets. The operator puts deficient tablets into predetermined cells 61 of the deficient tablet putting unit 78 to add the deficient tablets to the tablet supply apparatus 1.

As shown in FIG. 1, the tablet feeder 60 is provided at the upper portion of the front panel 2 of the tablet supply apparatus 1. Specifically, as shown in FIG. 1, a horizontally planar deficient tablets putting face 180 which is slender in the right and left direction is formed at the upper end portion of the front panel 2 so as to be lower in height than the top panel 7 by one step. A cut-out portion 79 whose length is set to T3 in the front-and-rear direction and T4 in the rear-and-left direction is formed on the deficient tablet putting face 180. The tablet feeder 60 is provided at the cut-out portion 79 under the state that the deficient tablet putting unit 78. The length T3 in the front-and-rear direction of the cut-out portion 79 is set to be substantially equal to the length T1 in the front-and-rear direction of the opening 70 of the cell 61, and the length T4 in the right-and-left direction of the cut-out portion 79 is set to be substantially equal to the length T5 in the right-and-left direction of the deficient tablet putting unit 78 (see FIG. 9A). Accordingly, only the deficient tablet putting unit 78 is exposed from the cut-out portion 79 as shown in FIG. 1.

When the operator puts deficient tablets into the tablet supply apparatus 1, the operator puts predetermined type and number of tablets into a predetermined cell 61 of the deficient tablet putting unit 78 exposed from the cut-out portion 78 of the deficient tablet putting face 180. Here, in the tablet supply apparatus 1 according to this embodiment, the tablet feeder 60 is mounted in the housing 5, and thus the tablets can be put into the tablet feeder 60 without drawing out the tablet feeder 60. Accordingly, when the tablet supply apparatus is installed, it is unnecessary that the space for the tablet feeder is ensured on the assumption that the tablet feeder 60 is drawn out, and thus the installation work can be facilitated. Particularly, in this embodiment, many cells 61 are arranged side by side in the deficient tablet putting unit 78, and thus deficient tablets associated with many separate packages can be put into the tablet feeder 60.

The tablet feeder 60 introduces deficient tablets put in a predetermined cell of the deficient tablet putting unit 78 of the tablet feeder 60 into the hopper 29 at a predetermined timing. Here, the basic operation until deficient tablets are introduced into the hopper 29 will be described with reference to FIG. 9A. The endless belt 65 is assumed to move in the direction of an arrow Y.

When preparation of separate packages by the tablet supply apparatus 1 is started, the endless belt 65 moves in the direction of the arrow Y4 by the amount corresponding to only one cell for preparation of one separate package. In connection with the movement of the endless belt 65, a cell 61 located at a position A1 turns over to a position A2 at an end portion 180R which is formed at one end of the endless belt 65 at the driven pulley 63 side. At this time, the opening 70 of the cell 61 concerned which faces upwardly at the position A1 faces downwardly at the position A2. In this process, deficient tablets accommodated in the tablet accommodating unit 171 of the cell 61 are discharged to a discharge portion 181R formed at the end portion 180R.

As shown in FIG. 3, a discharge chute 82R for leading deficient tablets discharged to the discharge portion 181R to the hopper 29 is provided between the discharge portion 81R and the hopper 29. The deficient tablets discharged to the discharge portion 81R are introduced through the discharge chute 82R into the hopper 29 as indicated by an arrow Y6 of FIG. 3. As described above, the deficient tablets put into the tablet feeder 60 are introduced into the hopper 29.

When the endless belt 65 moves in the direction of an arrow Y5, deficient tablets are discharged at a discharge portion 181L formed at the position of the shaft 62, and introduced into the hopper 29 through a discharge chute (not shown) which is provided so as to be joined to the discharge portion 81L.

Next, the operation of the tablet supply apparatus 1 when separate packages are prepared will be described.

On the basis of a prescription from a doctor or the like, the operator first inputs the type and number of tablets to be filled in each separate package into a personal computer connected to the tablet supply apparatus 1. On the basis of the input data, the personal computer determines whether there exists any deficient tablet in the tablets to be filled. When any deficient tablet exists, the personal computer informs the operator of information as to which type of tablets and how many tablets should be put into which cell 61 of the deficient tablet putting unit 78. Specifically, a cell 61 from which tablets should be first discharged to the discharge portion 181R (181L) is set as a first cell 61, a cell 61 from which tablets should be secondly discharged to the discharge portion 181R (181L) is set as a second cell 61, and so on. That is, the cells 61 of the deficient tablet putting unit 78 are ordered in order of putting tablets. Then, the personal computer notifies to the operator which type of tablets and how many tablets should be accommodated in what number of cell 61. This information is displayed on a display unit or printed to a sheet.

Figure 10A:
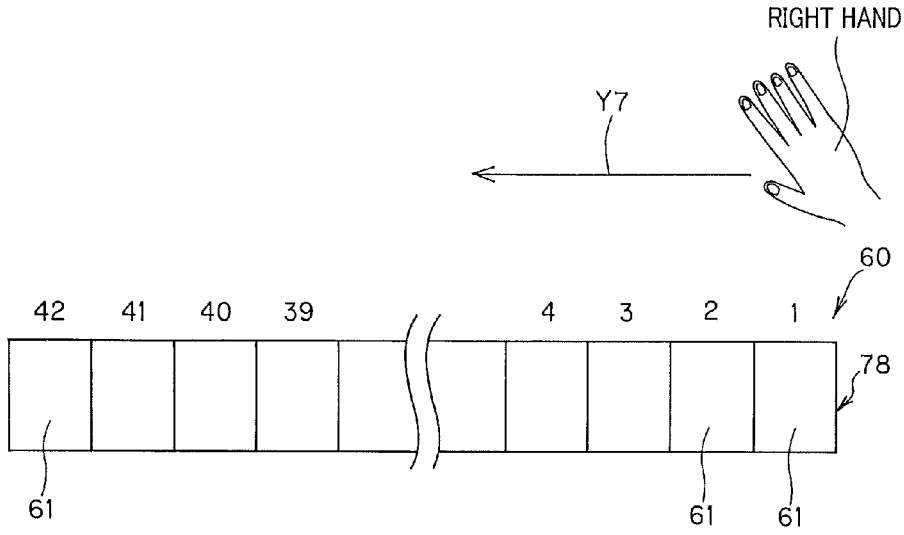
FIG. 10A is a diagram showing a work of putting deficient tablets into the tablet feeder by using a right hand.
Figure 10B:
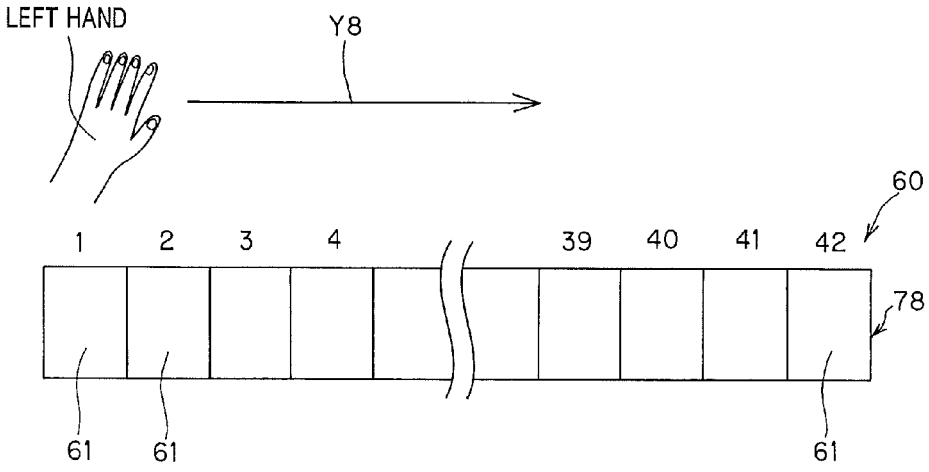
FIG. 10B is a diagram showing a work of putting deficient tablets into the tablet feeder by using a left hand.

FIGS. 10A and 10B are diagrams showing the operation of putting tablets into the tablet feeder 60 by the operator.

When the operator puts tablets into the tablet feeder 60, it is general that the operator holds tablets by his/her better arm and puts them into a predetermined cell 61. For example, a right-handed user generally holds deficient tablets and puts them into the cell 61 by his/her right hand. It is better for the operator to successively put deficient tablets from a cell 61 at the better arm side because the operator can more smoothly put the deficient tablets. Specifically, when deficient tablets are put by the right hand, the deficient tablets can be more smoothly put by successively putting the deficient tablets into the cells 61 from the cell 61 located at the right side of FIG. 10A as indicated by an arrow Y7 of FIG. 10A. Furthermore, when deficient tablets are put by the left hand, the deficient tables can be more smoothly put by successively putting the deficient tablets into the cells 61 from the cell 61 located at the left side of FIG. 10A as indicated by an arrow Y8 of FIG. 10B.

According to this embodiment, the operator successively puts deficient tablets from the cell 61 located at the more easily putting side in accordance with his/her better arm. Specifically, the right-handed operator sets the cell 61 at the right end of the deficient tablet putting unit 78 as a first cell 61, and puts deficient tablets into the cell 61 on the basis of the information from the personal computer. On the other hand, the left-handed operator sets the cell 61 at the left end of the deficient tablet putting unit 78 as a first cell 61, and puts deficient tablets into the cell 61 on the basis of the information from the personal computer.

After deficient tablets are put into predetermined cells 61 of the deficient tablet putting unit 78, the operator inputs through the input unit 13 which one of the direction of the arrow Y7 of FIG. 10A and the direction of the arrow Y8 of FIG. 10A should be selected as the direction along which the endless belt 65 is moved. Specifically, when the deficient tablets are successively put into the cells 61 from the cell 61 at the right side in front view of FIG. 10A by the right hand as shown in 10A, the operator inputs his/her instruction into the microcomputer so that the endless belt 65 is moved in the direction of the arrow Y7 of FIG. 10A. Accordingly, the deficient tablets are successively discharged from the cell 61 at the right end in front view into the discharge portion 181R. On the other hand, when the deficient tablets are successively put into the cells 61 from the cell 61 at the left side in front view of FIG. 10B by the left hand as shown in FIG. 10B, the operator inputs his/her instruction into the microcomputer so that the endless belt 65 is moved in the direction of the arrow Y8 of FIG. 10B. Accordingly, the deficient tablets are successively discharged from the cell 61 at the left end in front view into the discharge portion 181L.

After the above work is finished, the preparation of separate packages by the tablet supply apparatus 1 is started. Here, the operation of preparing one separate package will be described.

The controller specifies a tablet case 22 containing tablets to be filled in the separate package concerned on the basis of data input into the personal computer. The controller controls the driving unit 27 to discharge the tablets from the tablet case 22. At this time, the tablet detecting sensor detects the tablets discharged from the tablet case 22, and also outputs the detection value to the controller. The controller counts the number (amount) of the tablets discharged from the tablet case 22 on the basis of the detection value input from the tablet detecting sensor, and controls the driving unit 27 to stop the discharge of the tablets at the stage that a predetermined number (amount) of tablets have been discharged. The tablets discharged from the tablet case 22 are introduced into the hopper 29 by the tablet introducing unit 30.

At the same time, under the control of the controller, the driving motor 66 is driven, and the endless belt 65 is moved by the amount corresponding to one cell 61, so that the tablets accommodated in the cell 61 at the end portion 180L (180R) are discharged into the discharge portion 181L (181R). Specifically, when the endless belt 65 is moved in the direction of the arrow Y4 of FIG. 9A, the cell 61 is moved (turns over) from the position A1 to the position A2, so that the tablets put in this cell 61 are discharged to the discharge portion 181R. On the other hand, when the endless belt 65 is moved in the direction of the arrow Y5 of FIG. 9A, the cell 61 is moved (turns over) from the position A3 to the position a4, so that the tablets put in this cell 61 are discharged to the discharge portion 181L. The deficient tablets discharged to the discharge portion 181R (181L) are introduced through the discharge chute 82 into the hopper 29 as described.

As described above, the tablets are introduced into the tablet case 22 and the tablet feeder 60 into the hopper 29. The tablets introduced in the hopper 29 are filled into packaging paper through the nozzle 36. The packaging sheet filled with the tablets is compartmented by the thermal seal head 42 as described above, and cut out by the cutter 44, whereby a separate package filled with desired type and number (amount) of tablets is prepared. Subsequently, the tablet supply apparatus 1 sequentially executes the preparation of separate packages on the basis of the further data input to the personal computer.

As described above, in this embodiment, the tablet feeder 60 is provided inside the upper portion of the front side of the housing 5. The tablet feeder 60 has the plural cells 61 which are opened at the upper portion thereof and arranged on a line side by side to form a train. Each cell 61 is designed to be freely movable in connection with the movement of the endless belt 65, and tables accommodated in each cell 61 are discharged to the discharge portion 181L, 181R at the end portion 180L, 180R in the movement direction of the endless belt 65, and introduced into the hopper 29.

With this construction, the operator can add the tablets through the tablet feeder 60 into the tablet supply apparatus 1 under the state that the tablet feeder 60 is mounted in the housing 5. Accordingly, when the tablet supply apparatus 1 is mounted, it is unnecessary that the space for the tablet feeder is ensured on the assumption that the tablet feeder 60 is drawn out, and thus the installation work of the tablet supply apparatus 1 can be facilitated. Particularly, in this embodiment, many cells 61 are arranged side by side in the deficient tablet putting unit 78, and thus deficient tablets associated with many separate packages can be put into the tablet feeder 60.

Furthermore, in this embodiment, the operator can freely select any one of the direction of the arrow Y4 of FIG. 9A and the direction of the arrow Y5 of FIG. 9A as the moving direction of the endless belt 65. That is, the cells 61 can be freely moved in one direction or in the other direction (i.e., horizontal direction).

When deficient tablets are put into the deficient tablet putting unit 78, the operator successively puts the deficient tablets from the right-end cell 61 or the left-end cell 61 in accordance with his/her better arm, and then selects the moving direction of the endless belt 65 in accordance with the tablet putting order. In this case, the operator can most smoothly put the deficient tablets by using his/her own better arm, and thus the convenience can be enhanced for the operator.

Furthermore, in this embodiment, the cells 61 are secured to the endless belt 65 which are wound between a pair of the shaft 62 and the driven pulley 63 and horizontally moves. The endless belt 65 is selectively moved in one direction or the other direction, and when the cell 61 on the upward-facing surface of the endless belt 65 reaches the end portion 180L, 180R, the cell 61 turns over at the position of the shaft 62 or the driven pulley 63. At this time, the arrangement position of the cell 65 on the endless belt 65 is changed from the upward-facing surface to the downward-facing surface. At this time, deficient tablets in the cell 61 drop to the discharge portion 181L, 181R, and they are discharged through the discharge portion 181L, 181R into the hopper 29. Accordingly, the deficient tablets put into the tablet feeder 60 are finally surely introduced into the hopper 29 through the discharge portion 181L, 181R.

The present invention is not limited to the above embodiment, and various modifications and applications may be performed without departing from the subject matter of the present invention.

For example, in the above embodiment, the tablet supply apparatus 1 is designed so that the tablets discharged from the tablet case 22 are introduced into the hopper 29 by using one belt conveyor 31 in the tablet introducing unit 30. However, the present invention may be applied to an apparatus using no belt conveyor 31 or an apparatus using plural belt conveyors.

What is claimed is:

1. A tablet supply apparatus comprising:

a tablet case configured to accommodate tablets and to drop the tablets;

a hopper configured to receive the tablets dropped from the tablet case and to discharge the tablets;

a nozzle including a passage extending from a first end of the nozzle to a second end of the nozzle through which the tablets discharged by the hopper pass from the first end to the second end, a shutter for opening and closing the passage and a sensor provided above the shutter for detecting the tablets passing through the passage; and a controller connecting the tablet case, the shutter and the sensor, the controller controlling the tablet case to drop the tablets, the controller including a counter counting the number of the tablets detected by the sensor, and a timer time-counting a predetermined time from a time when the tablets are discharged from the tablet case, the predetermined time being set to be longer than a time which is required from the discharge of tablets from the tablet case until introduction of the tablets into the nozzle, wherein the controller makes the shutter open, if the timer has time-counted the predetermined time before the counter has counted a required number.

2. The tablet supply apparatus according to claim 1, wherein the shutter is disposed in the passage.

3. The tablet supply apparatus according to claim 1, wherein the sensor is disposed in the passage.

* * * * *